US007777414B2

(12) United States Patent
Honda

(10) Patent No.: US 7,777,414 B2
(45) Date of Patent: Aug. 17, 2010

(54) SEMICONDUCTOR DEVICE AND MANUFACTURING METHOD THEREOF

(75) Inventor: Tatsuya Honda, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 675 days.

(21) Appl. No.: 11/671,716

(22) Filed: Feb. 6, 2007

(65) Prior Publication Data

US 2007/0188077 A1 Aug. 16, 2007

(30) Foreign Application Priority Data

Feb. 10, 2006 (JP) ..... 2006-034380

(51) Int. Cl.
*H01J 1/62* (2006.01)

(52) U.S. Cl. ..... 313/509; 313/503; 445/24

(58) Field of Classification Search ..... 313/498–512; 315/169.1, 169.3; 428/690–691, 917; 438/26–29, 438/34, 82; 257/40, 72, 98–100, 642–643, 257/759; 427/58, 64, 66, 532–535, 539; 445/24–25

See application file for complete search history.

(56) References Cited

U.S. PATENT DOCUMENTS 6,866,555 B2 * 3/2005 Tsutsui et al. ..... 445/24
7,446,054 B2 11/2008 Yamazaki
2004/0041152 A1 3/2004 Eguchi
2005/0260804 A1 11/2005 Kang et al.
2006/0043410 A1 * 3/2006 Iwasaki et al. ..... 257/103
2006/0091397 A1 * 5/2006 Akimoto et al. ..... 257/72
2007/0042597 A1 2/2007 Yamazaki

FOREIGN PATENT DOCUMENTS

JP 2004-221132 8/2004
JP 2005-340776 12/2005
WO 2005/041280 5/2005

OTHER PUBLICATIONS

Search Report (Application No. 07001334.7) dated Jul. 13, 2009, 4 pages.

* cited by examiner

*Primary Examiner*—Peter J Macchiarolo
*Assistant Examiner*—Donald L Raleigh
(74) *Attorney, Agent, or Firm*—Fish & Richardson P.C.

(57) ABSTRACT

To provide a structure of a light emitting element superior in light emission efficiency to a top surface. A structure where two electrodes are arranged in a surface parallel to a substrate with a light emitting layer interposed therebetween, is provided. An electrode is not disposed below the light emitting layer. Therefore, by providing a reflective film below the light emitting layer, light emission efficiency to a top surface can be improved. For example, a film with a reflective index lower than that of the light emitting layer is provided, and light toward the lower side of the light emitting layer is reflected at an interface of the stack where the refractive index has a gap; accordingly, light emission efficiency to the top surface can be improved. In addition, a metal film with a high reflectance (a reflective metal film with a fixed potential or in a floating state) can be disposed below the light emitting layer.

19 Claims, 10 Drawing Sheets

SEMICONDUCTOR DEVICE AND MANUFACTURING METHOD THEREOF

BACKGROUND OF THE INVENTION

1. Field of the Invention

The present invention relates to a light emitting element using an inorganic material, and to a semiconductor device having a circuit including a light emitting element, and a manufacturing method thereof. For example, the present invention relates to an electronic device on which a light emitting display device having an inorganic light emitting element is mounted as a part.

Note that a semiconductor device in this specification refers to any type of device which can function by utilizing semiconductor characteristics. An electro-optical device, a semiconductor circuit and an electronic device are all included in the category of the semiconductor device.

2. Description of the Related Art

FIG. 10 shows a conventional structure of a light emitting element using an inorganic material. The light emitting element shown in FIG. 10 has a structure in which a lower electrode 2002, a first insulating film 2004, a light emitting layer 2006 including an inorganic semiconductor material, a second insulating film 2008, and an upper electrode 2010 are sequentially stacked over a substrate 2000. When a predetermined potential is supplied to each of the lower electrode 2002 and the upper electrode 2010, carriers (electrons) accelerated by a potential difference which is generated between those electrodes are trapped by impurity atoms in the light emitting layer 2006 or by an impurity level formed by the impurity atoms, and energy relaxation is caused. At that time, the energy is emitted as light.

In the case of using a metal material as a material of the lower electrode 2002 and the upper electrode 2010, light is emitted only in a direction parallel to a surface of the substrate 2000. Therefore, application to products is restricted.

A method for emitting light from an upper surface by making the thickness of the upper electrode 2010 using a metal material 5 to 20 nm is disclosed in Reference 1 (Reference 1: Japanese Published Patent Application No. 2004-221132).

SUMMARY OF THE INVENTION

Even when a transparent conductive film is used as the material of the upper electrode in the conventional structure, since light emitted toward the upper surface passes through the upper electrode, luminance of the emitted light is reduced. In addition, since a transparent conductive film has higher electrical resistivity than a metal material, voltage drop occurs, which causes a reduction in light emission efficiency of the light emitting element.

It is an object of the present invention to provide a structure of a light emitting element in which efficiency of light emission toward an upper surface is superior, and also to provide a semiconductor device, a display device and an electronic device including the light emitting element, and manufacturing methods thereof.

The present invention employs not the conventional structure where two electrodes are disposed on upper and lower sides of a light emitting layer, but rather a structure where two electrodes are arranged in a surface parallel to a substrate with a light emitting layer interposed therebetween.

In the present invention, an electrode is not disposed above a light emitting layer. Accordingly, light can be efficiently emitted from an upper surface.

Further, an electrode is not disposed below the light emitting layer either. Accordingly, the efficiency of light emission toward an upper surface can be improved by providing a reflective film below the light emitting layer. For example, a film with a lower refractive index than that of the light emitting layer is provided, so that light emitted toward a lower side of the light emitting layer is reflected at a stack interface where there is a difference in a refractive index. Accordingly, the efficiency of light emission toward an upper surface can be improved. In addition, a metal film with a high reflectance (a reflective metal film with a fixed potential or in a floating state) can be disposed below the light emitting layer.

One feature of a structure of a semiconductor device according to the invention disclosed in this specification is to include a first electrode and a second electrode disposed apart from each other and over an insulating surface, an insulating film covering the first electrode and the second electrode, and a light emitting layer containing an inorganic material over the insulating film. The light emitting layer is formed between a side surface of the first electrode and a side surface of the second electrode. The side surface of the second electrode is opposed to the side surface of the first electrode.

In addition, in order to improve light emission efficiency, stack layers having different refractive indexes may be provided below the light emitting layer so that light is reflected at the interface between the stack layers. Another feature of a structure of a semiconductor device according to the invention is to include a first insulating film over an insulating surface, a first electrode and a second electrode disposed apart from each other and over the first insulating film, a second insulating film covering the first electrode and the second electrode, and a light emitting layer containing an inorganic material over the second insulating film. The light emitting layer is formed between a side surface of the first electrode and a side surface, which is opposed to the side surface of the first electrode, of the second electrode. Regions of the first insulating film that overlap with the first electrode and the second electrode have a film thickness that is larger than the film thickness of the region between the first electrode and the second electrode.

Further, one feature of the above-described structure is that the second insulating film has a higher refractive index than the first insulating film. By adjusting the refractive indexes of the first insulating film and the second insulating film, light emission efficiency can be improved more.

In addition, in order to improve light emission efficiency, a reflective metal film may be provided below a light emitting layer so that light is reflected by a mirror surface. Still another feature of a structure of a semiconductor device according to the invention is to include a first insulating film over an insulating surface, a reflective metal film over the first insulating film, a first electrode and a second electrode disposed apart from each other and over the reflective metal film, a second insulating film covering the first electrode and the second electrode, and a light emitting layer containing an inorganic material over the second insulating film. The light emitting layer is formed between a side surface of the first electrode and a side surface, which is opposed to the side surface of the first electrode, of the second electrode. A third insulating film is formed between the reflective metal film and the first electrode and between the reflective metal film and the second electrode.

Further, one feature of the above-described structure is that a side surface of the third insulating film is in contact with the second insulating film. Furthermore, in the above-described structure, the reflective metal film is electrically in a floating state or fixed to a potential different from those of the first electrode and the second electrode. Further, Al, Ag, or the like may be used for the reflective metal film.

In each of the above-described structures, an inorganic compound semiconductor material in which an element such as Au, Ag, Cu, Mn or F or a plurality of such elements is added is used as a constituent substance of the light emitting layer. As the inorganic compound semiconductor material, a material containing Zn and at least one element selected from among S, Se or Te may be used. ZnS, ZnSe, ZnTe, or the like may be given as specific examples. GaN, SiC, ZnO, $Mg_xZn_{1-x}O$, or the like can be given as other inorganic compound semiconductor materials.

In each of the above-described structures, as the first insulating film, the second insulating film or the third insulating film, a single layer or stack layers selected from a silicon oxide film, a silicon nitride film, a silicon oxynitride film, an aluminum oxide film or a barium titanate ($BaTiO_3$) film formed by a PCVD method, a sputtering method or a coating method may be employed.

In each of the above-described structures, as the first electrode and the second electrode, conductive films containing an element selected from Al, W, Ti, Ta, Mo, Cu or In, or stack films thereof may be used.

Note that in this specification, an atmospheric refractive index (a vacuum refractive index) refers to a refractive index of 1.0, and a higher numeric value of the refractive index means a higher refractive index.

In addition, by arranging light emitting elements of the present invention in matrix, an active matrix light emitting display device can be manufactured. Further, the present invention is not limited to an active matrix light emitting device, and can also be applied to a passive matrix light emitting device.

One feature of each of the above-described structures is that, in the case of full-color display, the light emitting element emits light having any one color of red, green and blue. In addition, one feature of each of the above-described structures is that, in the case of single-color display, the plurality of light emitting elements all emits light of the same color—either red, green, blue or white. Further, the light emitting element which emits light having a single color and a fluorescent (color) filter may be combined to form a structure that conducts full-color display.

In addition, a manufacturing method for obtaining the above-described structures is also included in the present invention. Namely, a structure of the manufacturing method of a semiconductor device includes the steps of: forming a first insulating film over an insulating surface; forming a first electrode and a second electrode disposed apart from each other and over the first insulating film; forming a thin portion in the first insulating film by partially etching the first insulating film using the first electrode and the second electrode as masks; forming a second insulating film covering the thin portion of the first insulating film, the first electrode and the second electrode; and forming a light emitting layer containing an inorganic material over the second insulating film, in which the light emitting layer is formed between a side surface of the first electrode and a side surface, which is opposed to the side surface of the first electrode, of the second electrode.

By the structure of the present invention, efficiency of a light emitting element (luminance/current) can be improved and low power consumption can be realized. Further, light emission efficiency can be improved by providing a reflective multilayer film or a reflective metal film below a light emitting layer.

DETAILED DESCRIPTION OF THE INVENTION

Embodiment modes of the present invention are described hereinafter.

Embodiment Mode 1

First, a first insulating film 11 is formed to a thickness of 500 to 1000 nm over a substrate 10. As the substrate 10, a glass substrate having a light-transmitting property or a quartz substrate having a light-transmitting property may be used. A light-transmitting plastic substrate which can withstand a process temperature may also be used. Since light is emitted using a surface opposite to the substrate 10 side as a display surface (a surface through which light is emitted) in the present case, as well as the above-described substrates, a silicon substrate, a metal substrate or a stainless-steel substrate with an insulating film on its surface may also be used. Here, a glass substrate is used as the substrate 10. Note that the refractive index of a glass substrate is approximately 1.55.

As the first insulating film 11, a base film formed of an insulating film such as a silicon oxide film, a silicon nitride film, or a silicon oxynitride film is formed. An example of using a single layer structure for the base film is described here; however, a stack structure including two or more layers of insulating films may also be used. Here, a silicon oxide film with a thickness of 500 nm is formed by a CVD method.

Figure 1A:
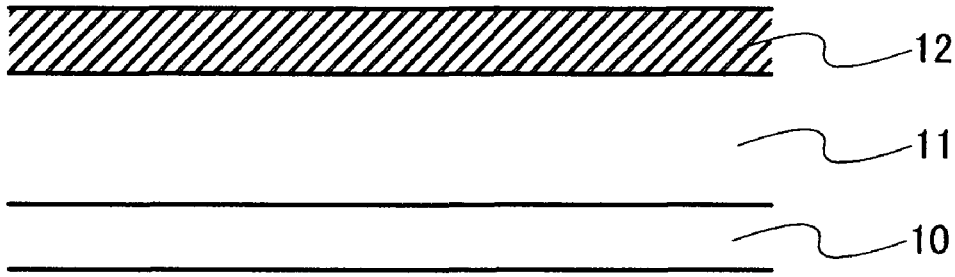
FIGS. 1A to 1D are cross sectional views of a manufacturing process of a light emitting element.

Then, a metal layer 12 with a thickness of 100 to 500 nm is formed over the first insulating film 11 (FIG. 1A). As the metal layer 12, a conductive film is formed of Al to a thickness of 500 nm by a sputtering method. Note that the metal layer is a single layer Al film here; however, the present invention is not limited to this, and a single layer or stack layers of an element selected from Ta, W, Ti, Mo, Cu or In, or an alloy material or a compound material containing the element as its main component may be formed as the metal layer. In addition, a semiconductor film typified by a polycrystalline silicon film doped with an impurity element such as phosphorus may be used as the metal layer 12.

Figure 1B:
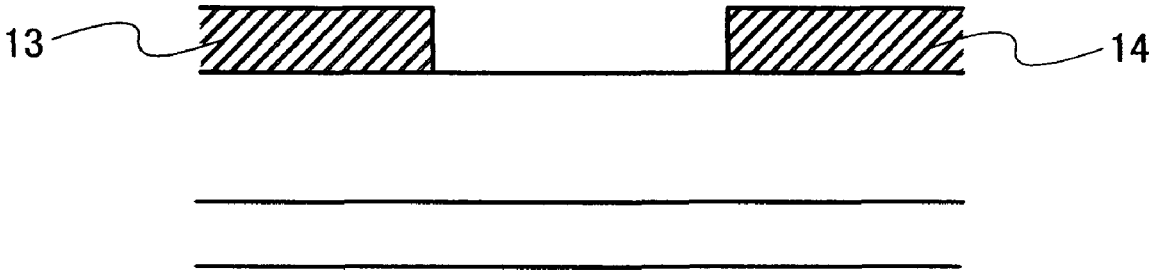

Next, a resist mask is formed by using a first photomask and an etching step is conducted by either a dry etching method or a wet etching method. By this etching step, the metal layer 12 is etched and a first electrode 13 and a second electrode 14 are obtained (FIG. 1B). Alternatively, a droplet containing a conductive material may be selectively discharged by a droplet discharge method such as an inkjet method and baked to form the first electrode 13 and the second electrode 14. Further alternatively, a resist mask may be formed by a droplet discharge method and then the metal layer 12 may be etched.

Figure 1C:
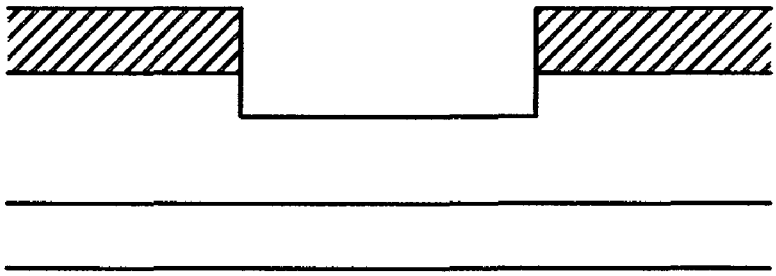

Next, after removing the resist mask, the first insulating film 11 is partially and thinly etched by using the first electrode 13 and the second electrode 14 as masks (FIG. 1C). Etching is conducted by using either a dry etching method or a wet etching method. Here, etching is conducted in a self-aligning manner so that, for example, the first insulating film 11 partially has a thickness of 400 nm. In other words, in the first insulating film 11, regions overlapping with the first electrode 13 and the second electrode 14 (regions with a thickness of 500 nm) are not etched, and are thicker than a region of the first insulating film 11 that is between the first electrode 13 and the second electrode 14 (a region with a thickness of 400 nm).

Figure 1D:
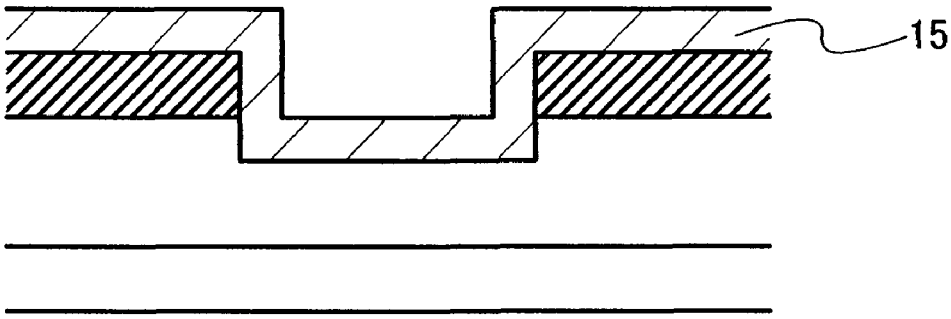

Next, a second insulating film 15 with a thickness of 100 nm is formed over the first electrode 13, the second electrode 14 and the exposed region of the first insulating film 11 (FIG. 1D). Here, as the second insulating film 15, an insulating film that is a $BaTiO_3$ film with a thickness of 100 nm is formed by a sputtering method. In considering light emitting efficiency, the thickness of the second insulating film 15 is 100 nm because the thickness of a depression portion etched thinly is 100 nm, here; however, the present invention is not limited to this.

Then, an inorganic compound semiconductor material film is formed to a thickness of 100 to 1000 nm over the second insulating film 15. Here, as the inorganic compound semiconductor material film, a ZnS film containing Mn is formed to a thickness of 500 nm by a sputtering method.

Figure 2A:
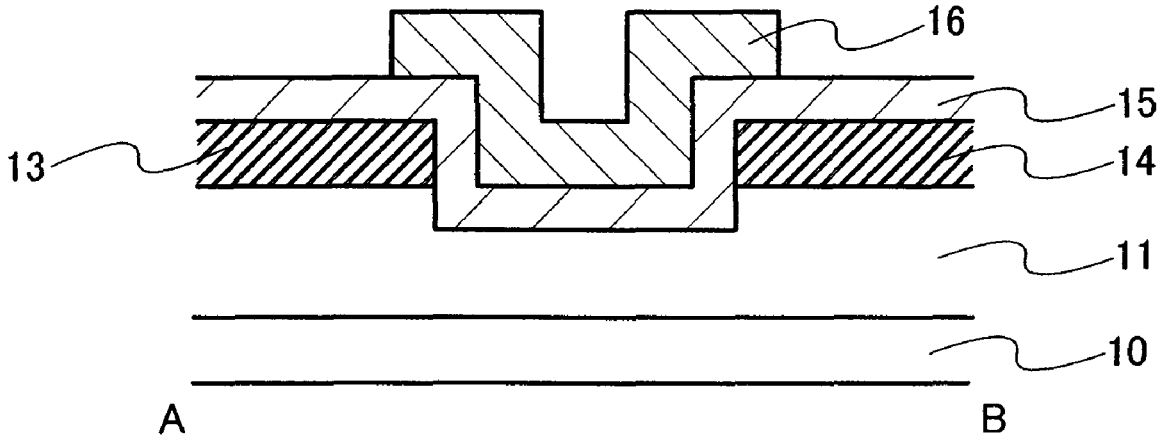
FIGS. 2A and 2B are a cross sectional view and a top view, respectively, of a light emitting element.

Next, a resist mask is formed using a second photomask and an etching step is conducted by either a dry etching method or a wet etching method. By this etching step, the inorganic compound semiconductor material film is etched to obtain a light emitting layer 16 (FIG. 2A). Alternatively, a resist mask may be formed by a droplet discharge method and the inorganic compound semiconductor material film may be etched.

When an alternating voltage or a direct voltage is applied to the first electrode 13 and the second electrode 14 in a light emitting element obtained in the above-described manner, Mn included in the ZnS film acts as an emission center, and visible light is emitted. The light emitting layer 16 is disposed between a side surface of the first electrode 13 and a side surface, which is opposed to the side surface of the first electrode 13, of the second electrode 14. Therefore, the light emitting layer 16 emits light toward upper and lower sides.

Light emitted toward the lower side of the light emitting layer 16 is reflected at an interface of the first insulating film 11 (the silicon oxide film, with a refractive index of 1.47) and the second insulating film 15 (the $BaTiO_3$ film, with a refractive index of 2.4). Thus, the amount of light emitted toward the upper side of the light emitting layer 16 is increased.

Figure 2B:
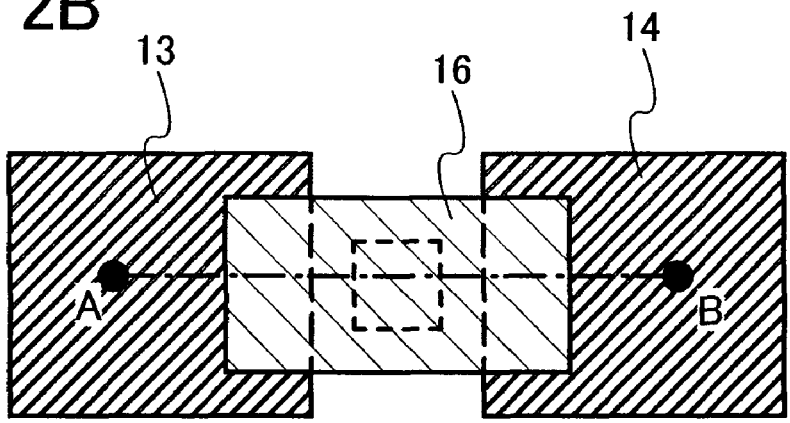

An example of a top view of the light emitting element obtained is shown in FIG. 2B. A cross sectional view taken along a chained line A-B of FIG. 2B corresponds to FIG. 2A.

Embodiment Mode 2

Figure 3:
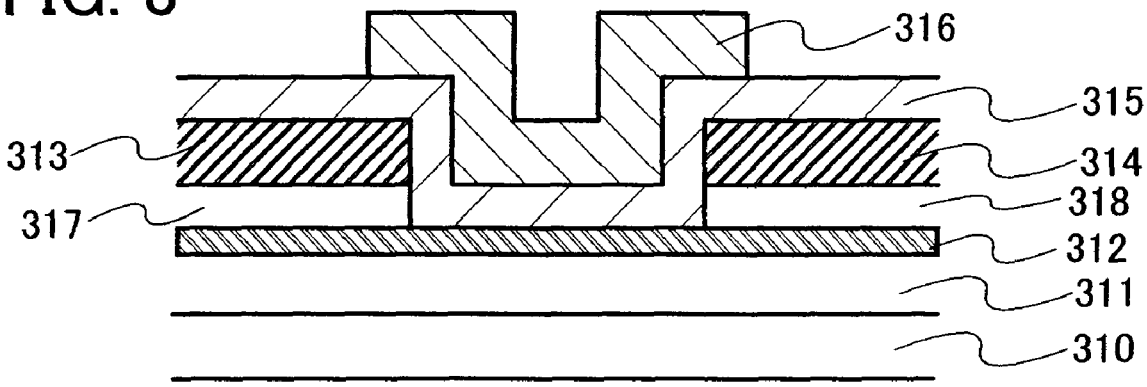
FIG. 3 is a cross sectional view of a light emitting element.

While the example of reflecting light using stack layers having different refractive indexes was described in Embodiment Mode 1, an example of providing a reflective metal film below a light emitting layer will be described in Embodiment Mode 2, with reference to FIG. 3.

A first insulating film 311 is formed over a substrate 310, in a similar manner to the corresponding step of Embodiment Mode 1. Then, a reflective metal film 312 is formed. For the reflective metal film 312, a material containing Al, Ag, Pt, or the like as its main component can be used. The reflective metal film 312 is formed to a thickness sufficient for obtaining enough reflectivity. Here, an Al film is used.

Next, a second insulating film is formed and a metal layer with a thickness of 100 to 500 nm is formed over the second insulating film. Then, a resist mask is formed by using a first photomask and an etching step is conducted by either a dry etching method or a wet etching method. The metal layer is etched by this etching step to obtain a first electrode 313 and a second electrode 314, and then an etching condition is changed and the second insulating film is selectively etched. Thus, insulators 317 and 318 are formed. The insulators 317 and 318 electrically insulate the reflective metal film 312 from the first electrode 313 and the second electrode 314.

Next, the resist mask is removed. Then, a third insulating film 315 with a thickness of 100 nm is formed over the first electrode 313, the second electrode 314 and the exposed part of the reflective metal film 312. Here, an insulating film that is a $BaTiO_3$ film with a thickness of 150 nm is formed by a sputtering method as the third insulating film 315.

Then, an inorganic compound semiconductor material film with a thickness of 100 to 1000 nm is formed over the third insulating film 315. Here, as the inorganic compound semiconductor material film, a ZnS film containing Mn is formed to a thickness of 500 nm by a sputtering method here.

Next, a resist mask is formed using a second photomask and an etching step is conducted by either a dry etching method or a wet etching method. The inorganic compound semiconductor material film is etched by this etching step to obtain a light emitting layer 316.

When an alternating voltage or a direct voltage is applied to the first electrode 313 and the second electrode 314 in a light emitting element obtained in the above-described manner, Mn included in the ZnS film acts as an emission center, and visible light is emitted. The light emitting layer 316 is disposed between a side surface of the first electrode 313 and a side surface, which is opposed to the side surface of the first electrode 313, of the second electrode 314. Therefore, the light emitting layer 316 emits light toward upper and lower sides.

Light emitted toward the lower side of the light emitting layer 316 is reflected at a surface of the reflective metal film 312. Thus, the amount of light emitted toward the upper side of the light emitting layer 316 is increased. Note that the reflective metal film 312 is electrically in a floating state at the time of light emission here; however, as long as the reflective metal film 312 is not electrically connected to the first electrode 313 and the second electrode 314, the present invention is not limited to this. A potential of the reflective metal film 312 may be fixed at a certain value at the time of light emission.

This embodiment mode may be freely combined with Embodiment Mode 1.

The present invention including the above-described structure will be described in more detail in the embodiments below.

Embodiment 1

Embodiment 1 will describe one structural example of a semiconductor device of the present invention with reference to the drawings. Specifically, a case where the structure of a circuit in which a plurality of light emitting elements are arranged is a passive matrix type will be described.

Over a substrate 400, a plurality of first wires 401 are disposed equally spaced apart from each other and in a stripe pattern. Second wires 402 are striped electrodes parallel to each other and extend so as to intersect the first wires 401. One light emitting element is disposed in the vicinity of an intersection of the first wire 401 and the second wire 402. By supplying potentials to the first wire 401 and the second wire 402, light emission occurs. A top view of this one light emitting element is shown in FIG. 4B, and a cross sectional view taken along a chained line C-D of FIG. 4B corresponds to FIG. 4A.

Figure 4A:
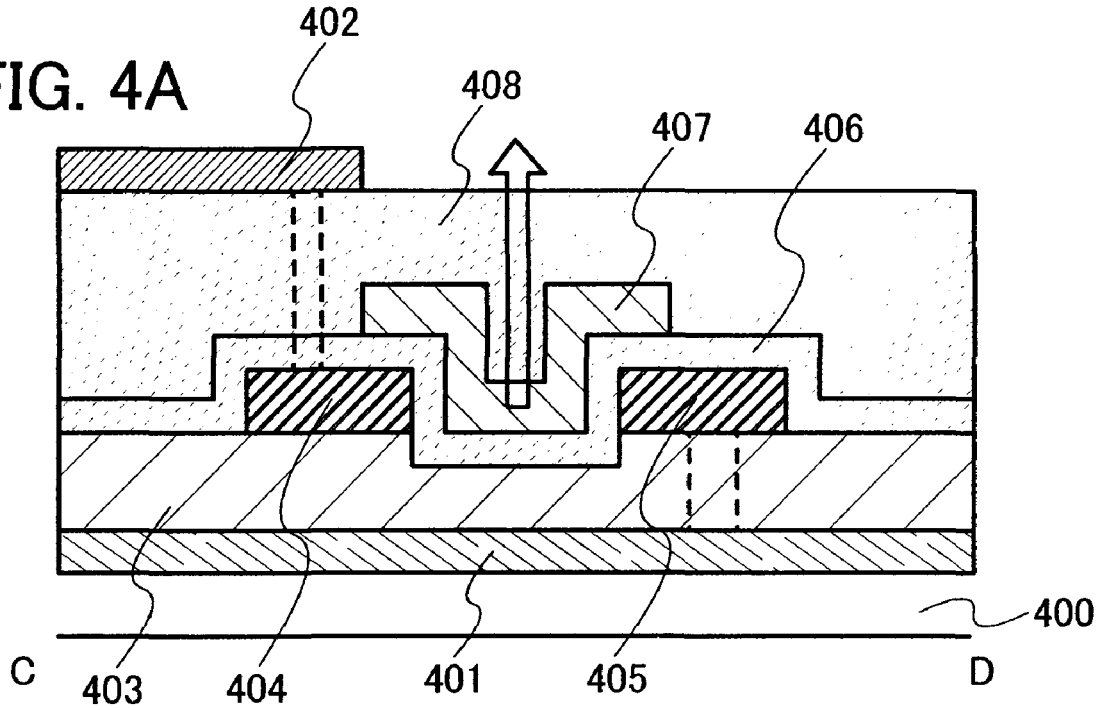
FIGS. 4A and 4B are a cross sectional view and a top view, respectively, of a semiconductor device.

As shown in FIG. 4A, a first electrode 404 is provided over a first insulating film 403 and is electrically connected to the second wire 402 through a contact hole which is provided in a second insulating film 406 and a third insulating film 408. In addition, a second electrode 405 is provided over the first insulating film 403 and is electrically connected to the first wire 401 through a contact hole which is provided in the first insulating film 403.

A region of the first insulating film 403, between the first electrode 404 and the second electrode 405 is thinner than another region. In addition, the second insulating film 406 is formed so as to cover the first electrode 404 and the second electrode 405. Further, in the region between the first electrode 404 and the second electrode 405, in other words, in a position overlapping the thin region of the first insulating film 403, a light emitting layer 407 is formed of an inorganic compound semiconductor material film.

Figure 4B:
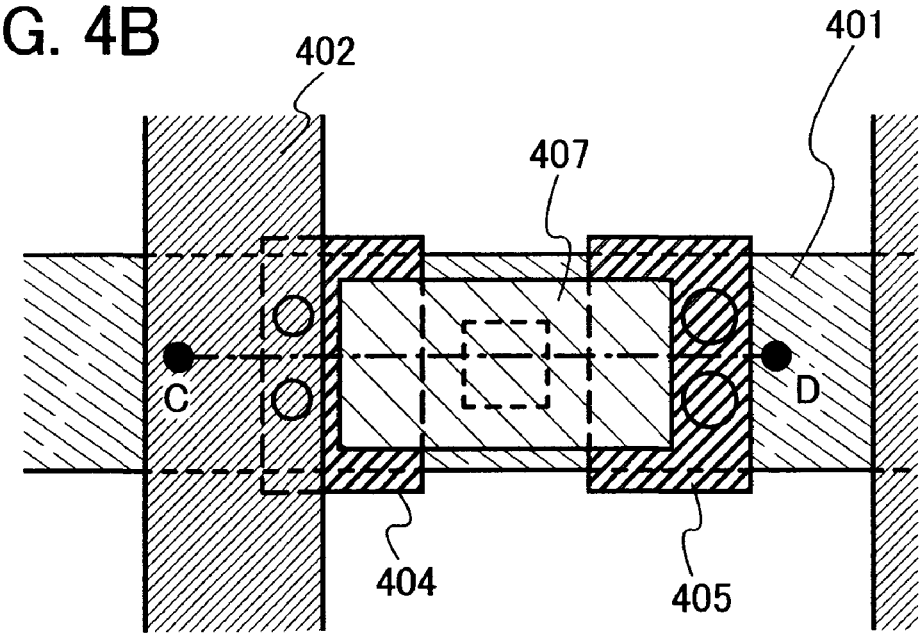

When an alternating voltage or a direct voltage is applied to the first electrode 404 and the second electrode 405 in the light emitting element shown in FIGS. 4A and 4B, an added substance (Au, Ag, Cu, Mn, F, or the like) included in the inorganic compound semiconductor material film acts as an emission center, and light is emitted in a direction indicated by an arrow in FIG. 4A. In the case of using a ZnS film in which Mn is added as the light emitting layer 407, Mn included in the ZnS film acts as an emission center, and visible light is emitted.

Further, when a material with a high refractive index, for example, a $BaTiO_3$ film with a refractive index of 2.4, is used for the second insulating film 406 and the third insulating film 408, since the light emitting layer 407 (the ZnS film in which Mn is added) has the same refractive index 2.4, light can be efficiently emitted toward the upper side of the light emitting layer 407. Accordingly, the second insulating film 406 and the third insulating film 408 are preferably formed of a material with the same or almost the same refractive index as that of the light emitting layer 407.

Light emitted toward the lower side of the light emitting layer 407 is reflected at an interface of the first insulating film 403 (a silicon oxide film with a refractive index of 1.47) and the second insulating film 406 (a $BaTiO_3$ film with a refractive index of 2.4). Thus, the amount of light emitted toward the upper side of the light emitting layer 407 is increased. In addition, if the first wire 401 is formed of a reflective metal film, light emitted toward the lower side of the light emitting layer 407 is reflected by a surface of the first wire 401. Thus, the amount of light emitted to the upper side of the light emitting layer 407 is increased even more.

In this embodiment, an example where the light emitting layer overlaps the first wire is described; however, the present invention is not limited to this, and a light emitting layer may be located in a region surrounded by a first wire and a second wire. In either structure, according to the present invention, materials for both the first wire and the second wire can be metal materials with low electrical resistivity. For example, an Al film, an Ag film, a Cu film, or the like can be used. Accordingly, driving voltage of the light emitting element can be reduced.

This embodiment can be freely combined with Embodiment Mode 1 or 2.

Embodiment 2

While an example of a passive matrix type is described in Embodiment 1, in Embodiment 2, an example of an active matrix type will be described. The active matrix type is a semiconductor device where a plurality of light emitting elements and a plurality of switching elements are disposed in matrix over a substrate having an insulating surface.

Figure 5:
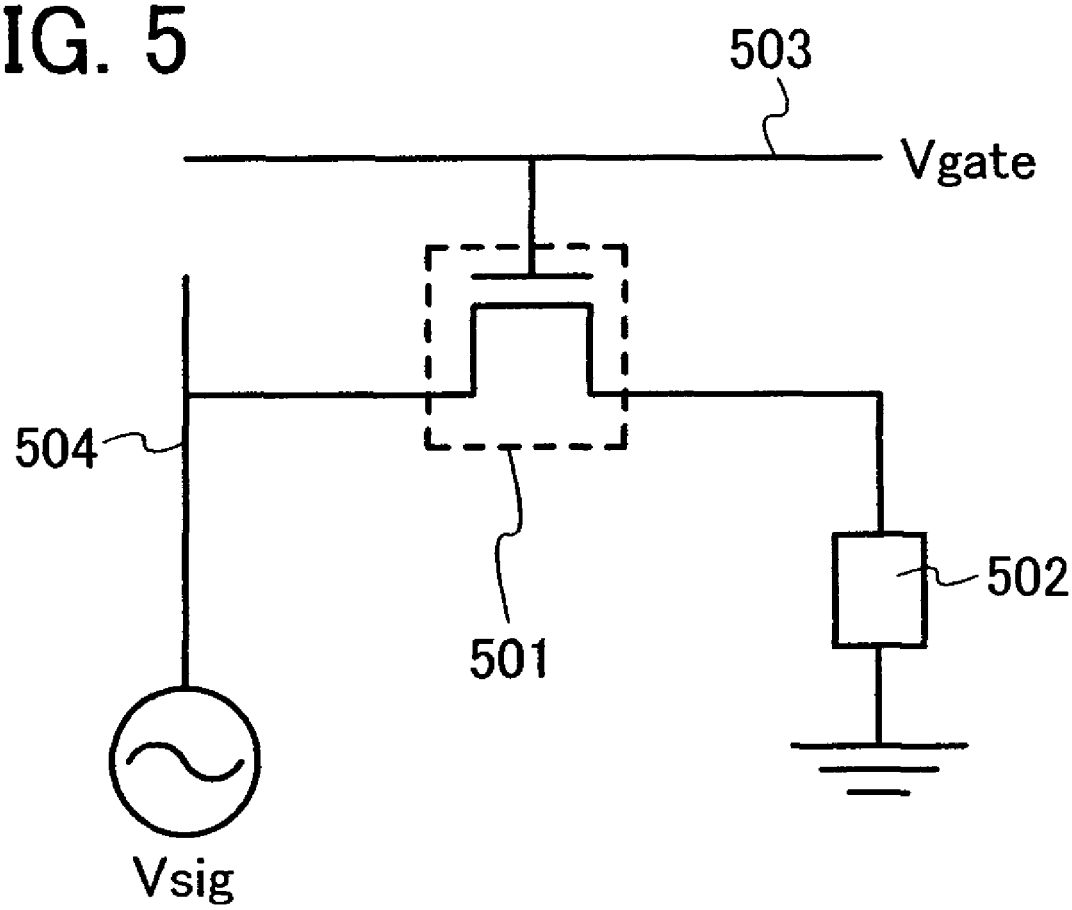
FIG. 5 shows an equivalent circuit.

FIG. 5 is an equivalent circuit diagram of a pixel portion using one transistor 501 as a switching element. The transistor 501 is used to switch a light emitting element 502. A direct voltage $V_{gate}$ for making the transistor on or off is applied to a gate line 503, and an alternating voltage or a direct voltage $V_{sig}$ for driving the light emitting element 502 is applied to a data line 504. Grayscale display can be performed by changing the magnitude of $V_{sig}$.

Figure 6:
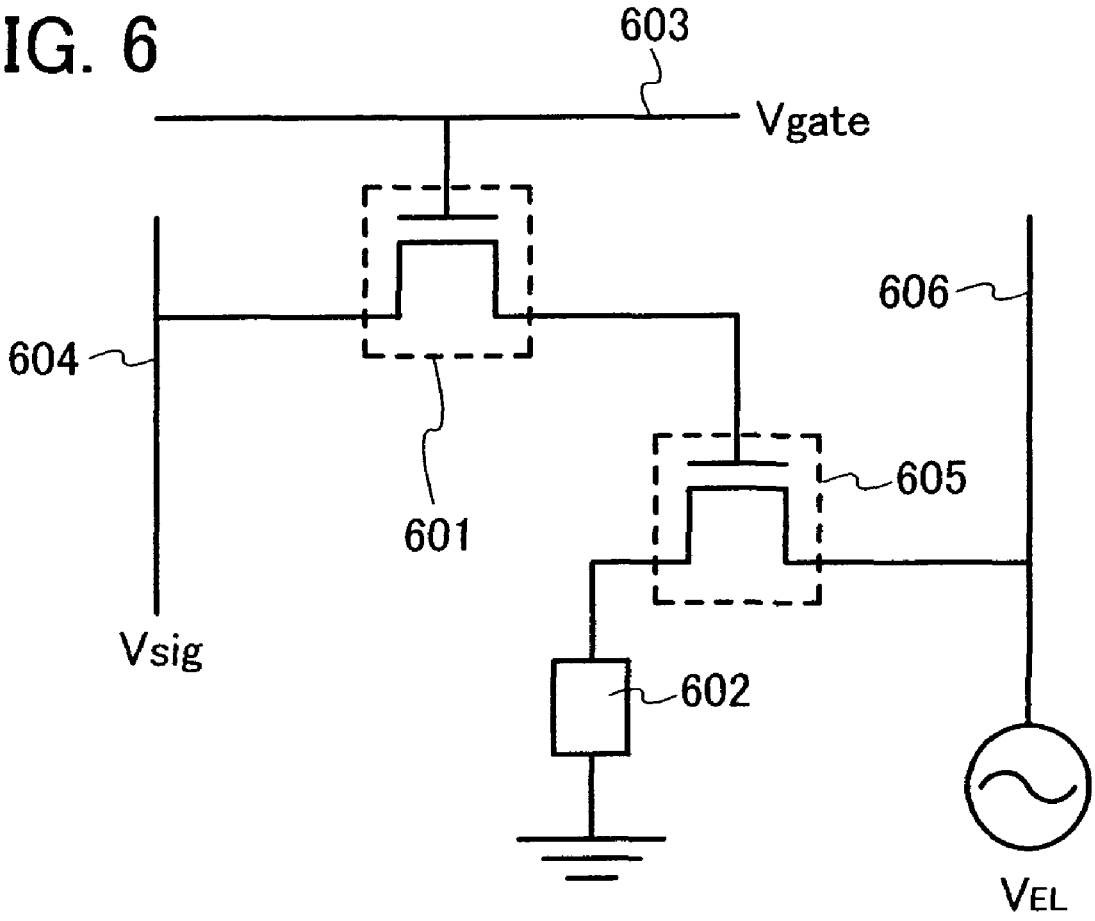
FIG. 6 shows an equivalent circuit.

FIG. 6 is an equivalent circuit diagram of a pixel portion using two transistors. In a circuit of a pixel portion, as well as a switching transistor 601, a driving transistor 605 for driving a light emitting element 602 is provided as a component of the circuit structure. In addition, a power source supply line 606 for supplying power to the light emitting element is included in the circuit of the pixel portion. In the case of the circuit of the pixel portion shown in FIG. 6, a direct voltage is applied to a data line 604 and a gate line 603, and a voltage $V_{EL}$ applied to the light emitting element 602 is an alternating voltage or a direct voltage.

A manufacturing process for the case of manufacturing an active matrix light emitting device including a pixel portion which uses two transistors will be described below.

First, a tungsten film is formed over a substrate 800 having an insulating surface by a sputtering method. Then, the tungsten film is selectively etched to form the gate line 603 and a gate electrode 701. A part of this gate line 603 becomes a gate electrode of the switching transistor 601. The gate electrode 701 functions as a gate electrode of the driving transistor 605.

Next, a first insulating film 801 which covers the gate line 603 and the gate electrode 701 is formed. A silicon oxynitride film is used as the first insulating film 801. Then, the first insulating film 801 is selectively etched to form a contact hole which reaches the gate electrode 701. A semiconductor film is then formed over the first insulating film 801. A ZnO film is used as the semiconductor film.

Next, the ZnO film is selectively etched to form a first semiconductor layer 702 and a second semiconductor layer 703. The first semiconductor layer 702 functions as an active layer of the switching transistor 601. In addition, the first semiconductor layer 702 is electrically connected to the gate electrode 701 through the contact hole provided in the first insulating film 801. The second semiconductor layer 703 functions as an active layer of the driving transistor 605.

Then, a second insulating film 802 which covers the first semiconductor layer 702 and the second semiconductor layer 703 is formed. A silicon oxide film is used as the second insulating film 802. The second insulating film 802 is selectively etched to form a contact hole which reaches the first semiconductor layer 702.

Next, a metal film, here an Al film containing a very small amount of Ti, is formed over the second insulating film 802. Then, the metal film is selectively etched to form the data line 604 and the power source supply line 606. The data line 604 is electrically connected to the first semiconductor layer 702 through the contact hole provided in the second insulating film 802.

Figure 7:
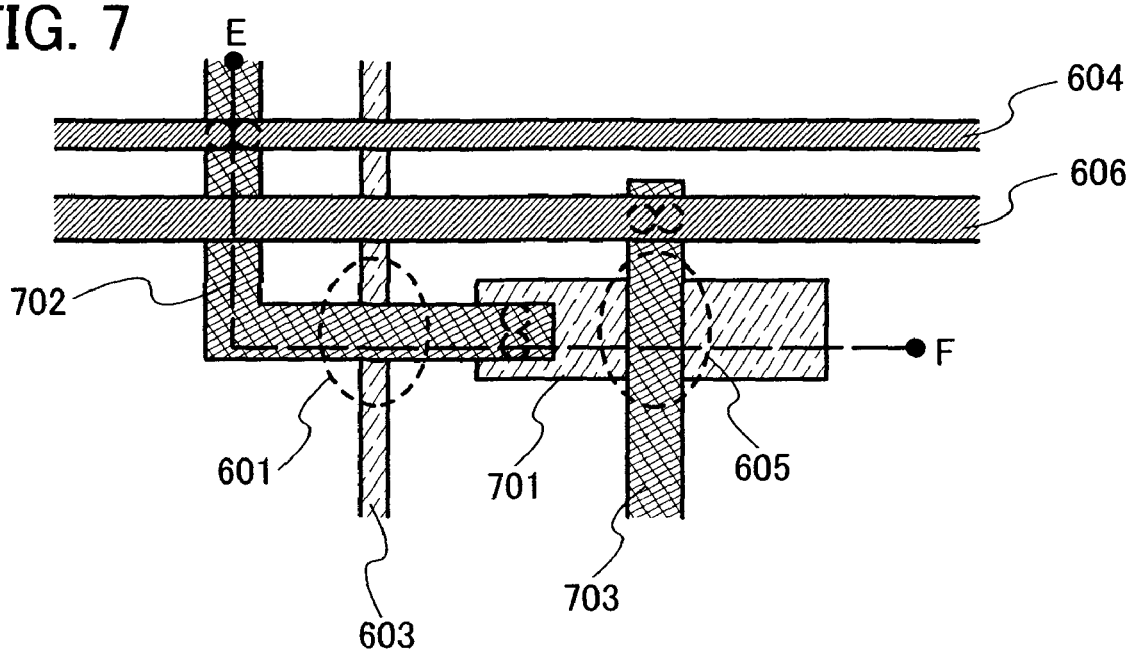
FIG. 7 is a top view during the manufacturing process.
Figure 8A:
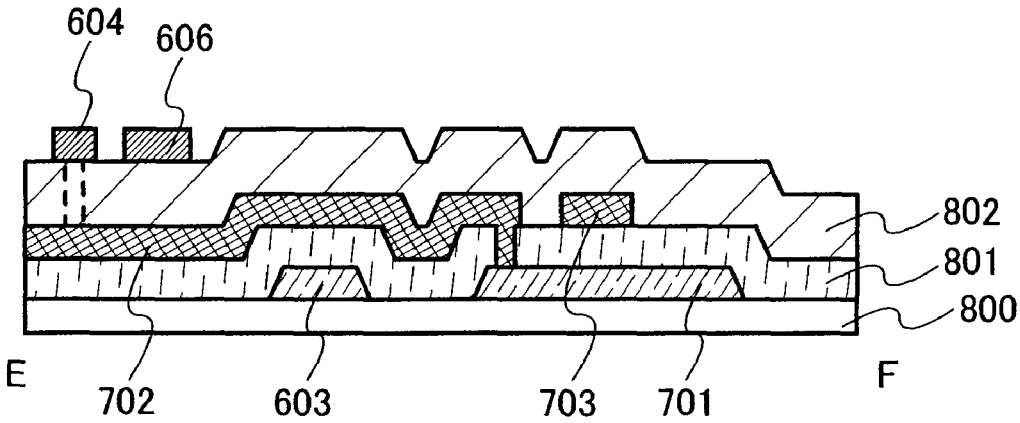
FIGS. 8A and 8B are cross sectional views of a semiconductor device.

A top view of the structure at the stage when the process described up to this point is finished is shown in FIG. 7. In FIG. 7, components the same as those of FIG. 6 are denoted by the same reference numerals. Further, a cross section taken along a dotted line E-F of FIG. 7 is shown in FIG. 8A. In FIG. 8A, components the same as those of FIG. 6 or FIG. 7 are denoted by the same reference numerals.

After obtaining the structure shown in FIG. 8A in this manner, a light emitting element is formed and stacked by carrying out a process similar to that described in Embodiment Mode 1.

A third insulating film 811 which covers the data line 604 and the power source supply line 606 is formed, and a metal layer with a thickness of 100 to 500 nm is formed in a similar manner to a corresponding step in Embodiment Mode 1. In this embodiment, as the third insulating film 811, a silicon oxide film is formed to a thickness of 500 nm by a CVD method. Then, the metal layer is selectively etched to obtain a first electrode 813 and a second electrode 814. Next, the third insulating film is partially and thinly etched using the first electrode 813 and the second electrode 814 as masks. Then, a fourth insulating film 815 is formed to a thickness of 100 nm over the first electrode 813 and the second electrode 814. In this embodiment, as the fourth insulating film 815, an insulating film that is a $BaTiO_3$ film is formed to a thickness of 100 nm.

Then, an inorganic compound semiconductor material film is formed to a thickness of 100 to 1000 nm over the fourth insulating film 815. In this embodiment, as the inorganic compound semiconductor material film, a ZnS film containing Mn is formed to a thickness of 500 nm by a sputtering method. Next, the inorganic compound semiconductor material film is selectively etched to obtain a light emitting layer 816.

When an alternating voltage or a direct voltage is applied to the first electrode 813 and the second electrode 814 in a light emitting element obtained in this manner, Mn included in the ZnS film acts as an emission center, and visible light is emitted.

Figure 8B:
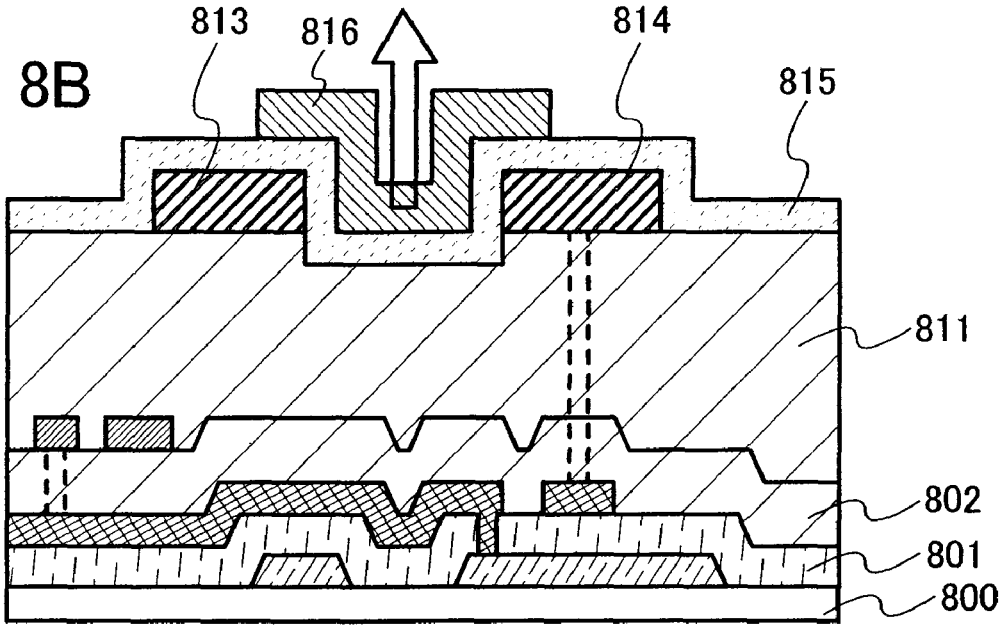

A cross sectional view of the structure at the stage when the process described up to this point is finished is shown in FIG. 8B.

If necessary, a protective film which is transparent to visible light may be formed over the light emitting layer 816. As the protective film which is transparent to visible light, a dense inorganic insulating film (a SiN film, a SiNO film, or the like) formed by a PCVD method, a dense inorganic insulating film (a SiN film, a SiNO film, or the like) formed by a sputtering method, a thin film mainly containing carbon (a DLC film, a CN film, an amorphous carbon film, or the like), a metal oxide film ($WO_2$, $CaF_2$, $Al_2O_3$, or the like), or the like is preferably used. In addition, a diamond like carbon film (also referred to as a DLC film) can be formed by a plasma CVD method (typically, an RF plasma CVD method, a microwave CVD method, an electron cyclotron resonance (ECR) CVD method, a thermal filament CVD method, or the like), a combustion flame method, a sputtering method, an ion beam deposition method, a laser deposition method, or the like. A reaction gas used for film formation is a hydrogen gas and a hydrocarbon-based gas (for example, $CH_4$, $C_2H_2$, $C_6H_6$, or the like). The reaction gas is ionized by glow discharge. The ions are accelerated to collide with a cathode which is applied with negative self bias, thus forming the film. A CN film may be formed by using a $C_2H_4$ gas and an $N_2$ gas as reactive gases. Note that the DLC film and the CN film are, depending on their thicknesses, insulating films which are transparent or semitransparent to visible light. Being transparent to visible light means that a film has a transmittance of visible light of 80 to 100%, and being semitransparent to visible light means that a film has a transmittance of visible light of 50 to 80%.

The present invention can be applied to anything that functions as a switching element, regardless of the structure of the switching element. FIG. 8A shows an example of using a bottom gate type (inversely staggered) transistor which uses a ZnO film formed over the insulating substrate; however, a top gate type transistor or a staggered transistor can also be used. Further, a transistor is not limited to a transistor having a single-gate structure, and a multi-gate transistor having a plurality of channel forming regions, for example, a double-gate transistor may be used.

This embodiment can be freely combined with Embodiment Mode 1 or Embodiment Mode 2.

Embodiment 3

Embodiment 3 will describe various electrical devices which are completed by using a light emitting device having a light emitting element of the present invention. Since a light emitting device using the present invention has low power consumption, the amount of power consumed by a display portion or a lighting portion, for example, of an electrical device using the light emitting device can be reduced.

Note that a light emitting device in this specification means an image display device, a light emitting device and a light source (including an illumination device). In addition, the light emitting device includes all of a module in which a light emitting device is connected to a connector such as an FPC (Flexible Printed Circuit), a TAB (Tape Automated Bonding) tape or a TCP (Tape Carrier Package), a module in which a printed wiring board is provided on the tip of a TAB tape or a TCP, and a module in which an IC (Integrated Circuit) is directly mounted on a light emitting element using COG (Chip On Glass) technology.

As an electrical device manufactured using a light emitting device of the present invention, there are a television, a camera such as a video camera or a digital camera, a goggle type display (head mounted display), a navigation system, an audio reproducing device (such as a car audio and an audio component stereo), a notebook personal computer, a game machine, a portable information terminal (such as a mobile computer, a portable phone, a portable game machine, and an electronic book), an image reproducing device provided with a recording medium (specifically, a device for reproducing a recording medium such as a digital video disc (DVD) and having a display device for displaying the reproduced image), a lighting equipment and the like. FIGS. 9A to 9E show specific examples of the electronic device. However, the electronic device using a light emitting device of the present invention is not limited to the shown specific examples.

Figure 9A:
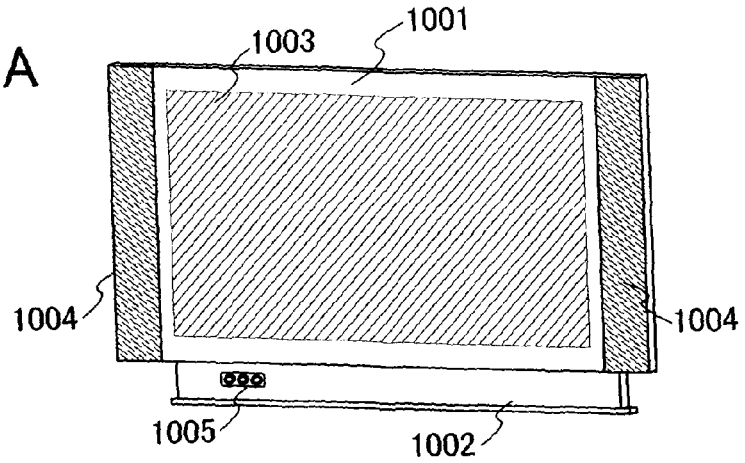
FIGS. 9A to 9E show examples of electronic devices.

FIG. 9A shows a display device including a housing 1001, a support base 1002, a display portion 1003, a speaker portion 1004, a video input terminal 1005, and the like. The display device is manufactured using a light emitting device which is formed in accordance with the present invention in the display portion 1003. Note that the display device includes all devices for displaying information such as for a personal computer, for receiving TV broadcasting, and for displaying an advertisement.

Figure 9B:
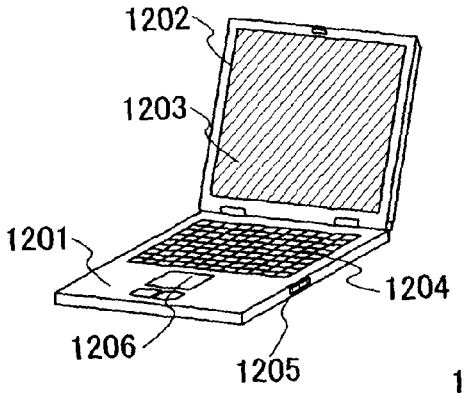

FIG. 9B shows a notebook personal computer including a main body 1201, a housing 1202, a display portion 1203, a keyboard 1204, an external connection port 1205, a pointing mouse 1206, and the like. The notebook personal computer is manufactured using a light emitting device including a light emitting element of the present invention in the display portion 1203.

Figure 9C:
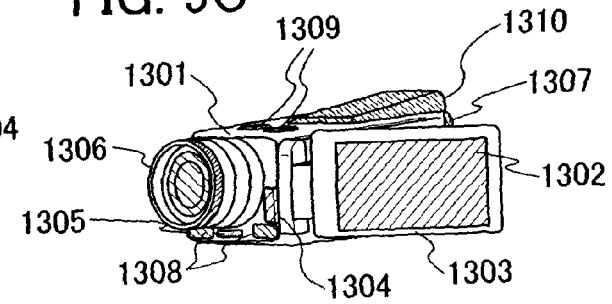

FIG. 9C shows a video camera including a main body 1301, a display portion 1302, a housing 1303, an external connection port 1304, a remote control receiving portion 1305, an image receiving portion 1306, a battery 1307, an audio input portion 1308, operation keys 1309, an eyepiece portion 1310, and the like. The video camera is manufactured using a light emitting device including a light emitting element of the present invention in the display portion 1302.

Figure 9D:
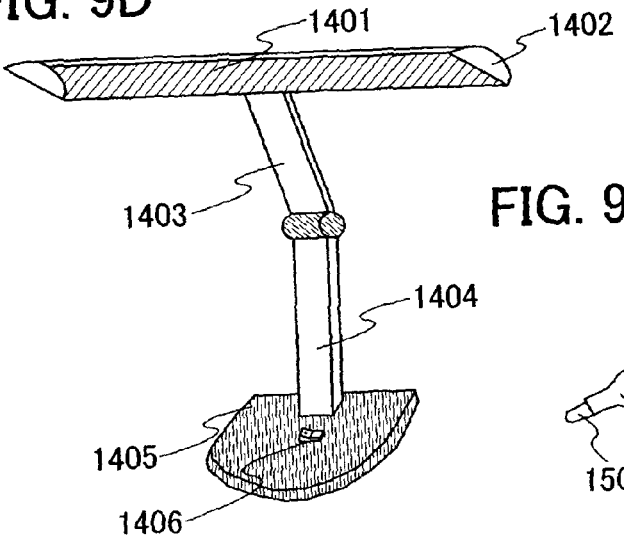

FIG. 9D shows a desk lamp including a lighting portion 1401, a shade 1402, an adjustable arm 1403, a support 1404, a base 1405 and a power supply 1406. The desk lamp is manufactured using a light emitting device formed by using a light emitting element of the present invention in the lighting portion 1401. Note that the term 'lighting equipment' encompasses a ceiling light, a wall light, and the like.

Figure 9E:
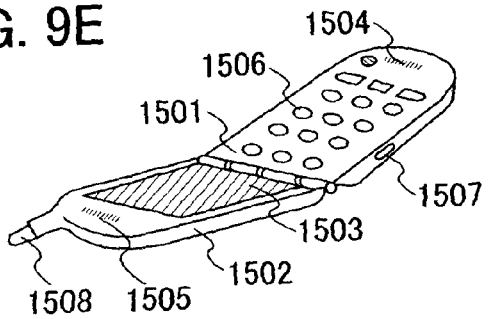
Figure 10:
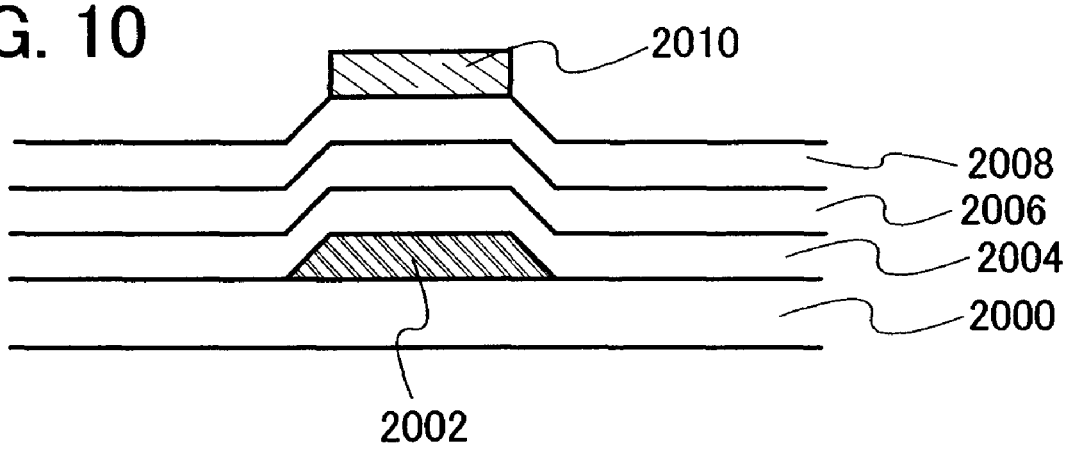
FIG. 10 shows a conventional example.

FIG. 9E shows a portable phone including a main body 1501, a housing 1502, a display portion 1503, an audio input portion 1504, an audio output portion 1505, operation keys 1506, an external connection port 1507, an antenna 1508, and the like. The portable phone is manufactured using a light emitting device including a light emitting element of the present invention in the display portion 1503.

In the above-described manner, an electrical device having a light emitting element or a light emitting device of the present invention can be obtained. Electrical devices using the present invention such as those, described above are economical, because the light emitting element of the present invention has excellent light emission efficiency and low power consumption.

This embodiment can be freely combined with Embodiment Mode 1, Embodiment Mode 2, Embodiment 1, or Embodiment 2.

This application is based on Japanese Patent Application serial no. 2006-034380 filed in Japan Patent Office on Feb. 10, 2006, the entire contents of which are hereby incorporated by reference.

What is claimed is:

1. A semiconductor device comprising:

a first electrode and a second electrode disposed apart from each other and in direct contact with an insulating surface;

an insulating film covering the first electrode and the second electrode; and a light emitting layer comprising an inorganic material over the insulating film, wherein the light emitting layer is formed between a side surface of the first electrode and a side surface, which is opposed to the side surface of the first electrode, of the second electrode.

2. A semiconductor device comprising:

a first insulating film over an insulating surface;

a first electrode and a second electrode disposed apart from each other and over the first insulating film;

a second insulating film covering the first electrode and the second electrode; and a light emitting layer comprising an inorganic material over the second insulating film, wherein the light emitting layer is formed between a side surface of the first electrode and a side surface, which is opposed to the side surface of the first electrode, of the second electrode, and wherein a thickness of a region of the first insulating film overlapping with the first electrode or the second electrode is larger than that of another region of the first insulating film between the first electrode and the second electrode.

3. The semiconductor device according to claim 2, wherein the second insulating film has a higher refractive index than the first insulating film.

4. A semiconductor device comprising:

a first insulating film over an insulating surface;

a reflective metal film over the first insulating film;

a first electrode and a second electrode disposed apart from each other and over the reflective metal film;

a second insulating film covering the first electrode and the second electrode; and a light emitting layer comprising an inorganic material over the second insulating film, wherein the light emitting layer is formed between a side surface of the first electrode and a side surface, which is opposed to the side surface of the first electrode, of the second electrode, and wherein a third insulating film is formed between the reflective metal film and the first electrode and between the reflective metal film and the second electrode.

5. The semiconductor device according to claim 4, wherein a side surface of the third insulating film is in contact with the second insulating film.

6. The semiconductor device according to claim 4, wherein the reflective metal film is electrically in a floating state or fixed to a potential which is different from those of the first electrode and the second electrode.

7. The semiconductor device according to claim 1, wherein a substance forming the light emitting layer is ZnO, ZnS, ZnSe, ZnTe, GaN, SiC or $Mg_xZn_{1-x}O$.

8. The semiconductor device according to claim 2, wherein a substance forming the light emitting layer is ZnO, ZnS, ZnSe, ZnTe, GaN, SiC or $Mg_xZn_{1-x}O$.

9. The semiconductor device according to claim 4, wherein a substance forming the light emitting layer is ZnO, ZnS, ZnSe, ZnTe, GaN, SiC or $Mg_xZn_{1-x}O$.

10. The semiconductor device according to claim 1, wherein at least one or a plurality of elements selected from Au, Ag, Cu, Mn, and F is added in the light emitting layer.

11. The semiconductor device according to claim 2, wherein at least one or a plurality of elements selected from Au, Ag, Cu, Mn, or F is added in the light emitting layer.

12. The semiconductor device according to claim 4, wherein at least one or a plurality of elements selected from Au, Ag, Cu, Mn, and F is added in the light emitting layer.

13. The semiconductor device according to claim 1, wherein the insulating film is a single layer or stack layers selected from a silicon oxide film, a silicon nitride film, a silicon oxynitride film, an aluminum oxide film and a barium titanate ($BaTiO_3$) film formed by a plasma CVD method, a sputtering method or a coating method.

14. The semiconductor device according to claim 2, wherein the second insulating film is a single layer or stack layers selected from a silicon oxide film, a silicon nitride film, a silicon oxynitride film, an aluminum oxide film and a barium titanate ($BaTiO_3$) film formed by a plasma CVD method, a sputtering method or a coating method.

15. The semiconductor device according to claim 4, wherein the second insulating film is a single layer or stack layers selected from a silicon oxide film, a silicon nitride film, a silicon oxynitride film, an aluminum oxide film and a barium titanate ($BaTiO_3$) film formed by a plasma CVD method, a sputtering method or a coating method.

16. The semiconductor device according to claim 1, wherein the first electrode and the second electrode are conductive films containing an element selected from Al, W, Ti, Ta, Mo, Cu or In or stack films thereof.

17. The semiconductor device according to claim 2, wherein the first electrode and the second electrode are conductive films containing an element selected from Al, W, Ti, Ta, Mo, Cu or In or stack films thereof.

18. The semiconductor device according to claim 4, wherein the first electrode and the second electrode are conductive films containing an element selected from Al, W, Ti, Ta, Mo, Cu or In or stack films thereof.

19. A manufacturing method of a semiconductor device, comprising the steps of:

forming a first insulating film over an insulating surface;

forming a first electrode and a second electrode disposed apart from each other and over the first insulating film;

forming a thin portion in the first insulating film by partially etching the first insulating film using the first electrode and the second electrode as masks;

forming a second insulating film covering the thin portion of the first insulating film, the first electrode and the second electrode; and forming a light emitting layer containing an inorganic material over the second insulating film, wherein the light emitting layer is formed between a side surface of the first electrode and a side surface, which is opposed to the side surface of the first electrode, of the second electrode.

* * * * *